US006425328B2

(12) United States Patent
Sodeyama et al.

(10) Patent No.: US 6,425,328 B2
(45) Date of Patent: Jul. 30, 2002

(54) PLATE-MAKING SHEET AND PLATE-MAKING SHEET PRINTING DEVICE

(75) Inventors: Hideo Sodeyama, Matsumoto; Kenji Watanabe, Tokyo; Takuya Suetani, Tokyo; Kiyoshi Ogawa, Tokyo, all of (JP)

(73) Assignees: Seiko Epson Corporation; King Jim Co., Ltd., both of Tokyo (JP)

( * ) Notice: Subject to any disclaimer, the term of this patent is extended or adjusted under 35 U.S.C. 154(b) by 0 days.

(21) Appl. No.: 09/915,709

(22) Filed: Jul. 25, 2001

Related U.S. Application Data

(62) Division of application No. 09/300,068, filed on Apr. 27, 1999, now Pat. No. 6,295,926.

(30) Foreign Application Priority Data

Apr. 30, 1998 (JP) ..... 10-137523

(51) Int. Cl.[7] ..... B41J 21/16; B41K 1/02
(52) U.S. Cl. ..... 101/401.1; 400/615.2
(58) Field of Search ..... 101/327, 401.1; 400/61, 70, 76, 81, 83, 582, 586, 569, 599, 615.2

(56) References Cited

U.S. PATENT DOCUMENTS

| | | | | |
|---|---|---|---|---|
| 4,746,233 A | | 5/1988 | Garcia De Osuna et al. | 400/625 |
| 5,267,800 A | | 12/1993 | Petteruti et al. | 400/61 |
| 5,458,423 A | | 10/1995 | Sims et al. | 400/621 |
| 5,727,946 A | | 3/1998 | Rosen | 101/327 |
| 5,791,791 A | | 8/1998 | Watanabe et al. | 400/76 |
| 5,885,012 A | | 3/1999 | Hastings et al. | 400/83 |
| 5,957,053 A | | 9/1999 | Hayama | 101/401.1 |
| 6,016,749 A | | 1/2000 | Tukahara et al. | 101/401.1 |
| 6,116,157 A | * | 9/2000 | Hayama et al. | 101/114 |

FOREIGN PATENT DOCUMENTS

JP 09/300795 11/1997

* cited by examiner

*Primary Examiner*—Stephen R. Funk
(74) *Attorney, Agent, or Firm*—Hogan & Hartson, L.L.P.

(57) ABSTRACT

There are provided a plate-making sheet and a printing device for printing on the plate-making sheet. The plate-making sheet is in the form of a strip and for being printed with stamp characters to be engraved on a stamping face of a stamp, in parallel with a process for making the stamp, for permitting checking of the stamp characters and for indication of the stamp characters on a back surface of the stamp. The plate-making sheet comprises a backing sheet, and an adhesive sheet laminated on the backing sheet and having a surface to be printed with the stamp characters. The surface of adhesive sheet is formed with a character check area to be printed with the stamp characters for permitting the checking of the stamp characters, and at least one indication character area to be printed with the stamp characters for the indication of the stamp characters. In the printing device, a printing mechanism prints stamp characters in a character check area and at least one indication character area. A feeding mechanism feeds the plate-making sheet to the printing mechanism. A sensor detects feed of the plate-making sheet to the printing mechanism.

3 Claims, 14 Drawing Sheets

PLATE-MAKING SHEET AND PLATE-MAKING SHEET PRINTING DEVICE

This is a divisional of application Ser. No. 09/300,068 filed Apr. 27, 1999, now U.S. Pat No. 6,295,926, which application is hereby incorporated by reference in its entirety.

BACKGROUND OF THE INVENTION

1. Field of the Invention

This invention relates to a plate-making sheet for being printed with stamp characters to be engraved on the stamping face of a stamp, in parallel with a process for making the stamp, mainly for permitting checking of the stamp characters and for indication of the stamp characters on the back surface of the stamp, and a printing device for printing the stamp characters on the plate-making sheet.

2. Prior Art

Conventionally, a stamp making apparatus has been proposed e.g. by Japanese Laid-Open Patent Publication (Kokai) No. 6-278350, which makes a stamp from a stamp body having a stamping surface formed of an ultraviolet curing resin. This apparatus uses an ink ribbon as an exposure mask, and a printing paper ribbon which corresponds to the above-mentioned plate-making sheet. The two ribbons, placed one upon the other, are in the form of a roll wound about a supply reel. The stamp making apparatus has a printing block including a print head and a platen roller. The ink ribbon and the printing paper ribbon are rolled out from the supply reel by the platen roller and guided to the print head which prints stamp characters simultaneously on the ink ribbon and the printing paper ribbon (by transfer of ink). Thereafter, the ink ribbon is advanced to an exposure device facing the stamp body set in the apparatus, while the printing paper ribbon is discharged from a take-out slot of the apparatus. A stamp character label is peeled off the printing paper ribbon and cut or trimmed properly. Then, the label is affixed to the back surface of the stamp body processed by exposure to ultraviolet rays.

In the case of such a conventional stamp making apparatus, an image of stamp characters is transferred from the ink ribbon to the printing paper ribbon, and hence an image of the stamp characters (engraved on the stamping face) of a stamp made by using the exposure mask of the ink ribbon, and an image of the stamp characters printed on the printing paper ribbon become identical to each other. On the other hand, in an image of an imprint of the stamp characters formed by using the stamp, images of individual characters are slightly bolder than those of the characters engraved on the stamping face of the stamp. That is, the images of the characters engraved on the stamping face are identical in boldness or thickness with those of the characters imprinted on the label affixed to the back surface of the stamp, but different from the images of the stamp characters imprinted by using the stamp. Particularly, to make a stamp limited in character width or a small-sized stamp, it is required to engrave or form characters on the stamping face in an even thinner typeface by taking into account defacing or broadening of images of stamp character imprinted by using the stamp. In such a case, the characters printed on the label affixed to the back surface of the stamp become very thin and difficult to read. Further, an imprint of stamp characters formed by using the stamp gives the viewer an impression different from one received from the printed stamp characters on the label affixed to the back surface of the stamp.

SUMMARY OF THE INVENTION

It is a first object of the invention to provide a plate-making sheet that eliminates the inconvenience that characters indicated on the back surface of a stamp are difficult to read, and at the same time prevents an image of the characters imprinted by using the stamp and an image of the printed characters indicated on the back surface of the stamp from becoming different in boldness to cause a sense of disagreement between them.

It is a second object of the invention to provide a printing device that is capable of accurately printing stamp characters at proper positions on the plate-making sheet that eliminates the inconvenience that characters indicated on the back surface of a stamp are difficult to read, and at the same time prevents an image of the characters imprinted by using the stamp and an image of the printed characters indicated on the back surface of the stamp from becoming different in boldness to cause a sense of disagreement between them.

To attain the first object, according to a first aspect of the invention, there is provided a plate-making sheet in the form of a strip for being printed with stamp characters to be engraved on a stamping face of a stamp, in parallel with a process for making the stamp, for permitting checking of the stamp characters and for indication of the stamp characters on a back surface of the stamp, the plate-making sheet comprising:

a backing sheet, and an adhesive sheet laminated on the backing sheet and having a surface to be printed with the stamp characters, wherein the surface of the adhesive sheet is formed with a character check area to be printed with the stamp characters for permitting the checking of the stamp characters, and at least one indication character area to be printed with the stamp characters for the indication of the stamp characters.

According to this plate-making sheet, the character check area to be printed with the stamp characters for permitting the checking thereof and the at least one indication character area to be printed with the stamp characters for the indication thereof are provided on the sheet. Therefore, an image of the stamp characters printed on the character check area can be used for checking on the stamp characters to be engraved on the stamping face of a stamp to confirm that there is no error in the stamp characters, for instance, while the stamp characters printed on the at least one indication character area can be used for indicating the stamp characters as a faithful reproduction of an imprint of the stamp or as an image of the stamp characters formed with preference to legibility, on the back surface of the stamp. Further, if a plurality of indication character areas are provided to print thereon images of stamp characters different in boldness, the user can select a desirable one from the images of the stamp characters which can be indicated on the back surface of the stamp, as he desires. Furthermore, the plate-making sheet is in the form of a strip which is constituted by a backing sheet, and an adhesive sheet. laminated on the backing sheet and having a surface to be printed with the stamp characters, which makes the plate-making sheet easy to handle. By cutting out an indication character area of the adhesive sheet it can be easily affixed to the back surface of the stamp. It should be noted that throughout the specification, the term "stamp character" is used to denote any letter as well as any symbol, figure or the like which can be employed in a stamp i.e. engraved on the stamping face of the stamp.

Preferably, each of the at least one indication character area is formed to have a shape corresponding to a shape of the back surface of the stamp.

According to this preferred embodiment, it is possible to form a label corresponding to the shape of the back surface of a stamp simply by cutting out the printed indication character area.

Preferably, the each of the at least one indication character area is formed such that the each of the at least one indication character area can be peeled off the backing sheet along a cutting line formed in the adhesive sheet.

According to this preferred embodiment, by peeling only the printed indication character area off the backing sheet along the cutting line formed in the adhesive sheet, a label affixable to the back surface of the stamp can be easily obtained without cutting the sheet.

Preferably, the character check area is arranged at a longitudinally central location of the plate-making sheet.

According to this preferred embodiment, it becomes possible to print stamp characters on the character check area without considering a forward end side or a rearward end side of the plate-making sheet.

Preferably, the at least one indication character area comprises a plurality of indication character areas, and the plurality of indication character areas are arranged at respective diametrically centrosymmetric locations with respect to a center of the plate-making sheet.

According to this preferred embodiment, it becomes possible to print stamp characters in any of the plurality of indication character areas without considering a forward end side or a rearward end side of the plate-making sheet. In this case, however, it is not necessarily required to print stamp characters on the indication character areas on both of the opposite sides of the center of the plate-making sheet.

Preferably, a detecting hole cooperative with a sensor is formed at a location spaced from a longitudinal end of the plate-making sheet and lying outside the character check area and the at least one indication character area.

According to this preferred embodiment, the longitudinal end of the plate-making sheet and the detecting hole are detected by the sensor, whereby the printing device for carrying out the printing while feeding the plate-making sheet can detect the presence of the sheet through detection of the longitudinal end of the sheet, and then detect a print-starting position on the sheet through detection of the detecting hole.

Preferably, the location of the detecting hole is closer to a longer side of the plate-making sheet.

According to this preferred embodiment, the sensor detects the presence or absence of the detecting hole, to thereby simultaneously discriminate whether or not the plate-making sheet is mounted with the front surface thereof, i.e. the adhesive sheet side thereof, facing in a proper direction. Hence, it is possible to prevent printing from being carried out on the backing sheet.

Preferably, the detecting hole comprises a pair of through holes, the pair of through holes being arranged at respective diametrically centrosymmetric locations with respect to a center of the plate-making sheet.

According to this preferred embodiment, when the plate-making sheet is fed for printing, it is possible to discriminate whether or not the front surface of the sheet is facing in a proper direction, irrespective of the direction of feeding of the plate-making sheet, that is, without need for being conscious of a forward end side or rearward end side of the plate-making sheet for feeding the same.

To attain the first object, according to a second aspect of the invention, there is provided a plate-making sheet for being printed with stamp characters to be engraved on a stamping face of a stamp, in parallel with a process for making the stamp, for permitting checking of the stamp characters and for indication of the stamp characters on a back surface of the stamp, the plate-making sheet comprising a printing surface formed with a character check area to be printed with the stamp characters for permitting the checking of the stamp characters, and at least one indication character area to be printed with the stamp characters for the indication of the stamp characters.

According to this plate-making sheet, the character check area to be printed with stamp characters for permitting the checking thereof and the at least one indication character area to be printed with the stamp characters for the indication thereof are provided on the sheet. Therefore, an image of the stamp characters printed on the character check area can be used for checking on the stamp characters to be engraved on the stamping face of a stamp to confirm that there is no error in the stamp characters, for instance, while the stamp characters printed on the at least one indication character area can be used for indicating the stamp characters as a faithful reproduction of an imprint of the stamp or as an image of the stamp characters formed with preference to legibility, on the back surface of the stamp.

Preferably, each of the at least one indication character area is defined and indicated as an area having a shape corresponding to a shape of the back surface of the stamp.

According to this preferred embodiment, it is possible to form a label corresponding to the shape of the back surface of the stamp simply by cutting out the printed indication character area along a line defining and indicating the area.

To attain the second object, according to a third aspect of the invention, there is provided a printing device for printing on a plate-making sheet for use in making a stamp, the plate-making sheet being formed with a character check area to be printed with stamp characters for permitting checking of the stamp characters, and at least one indication character area to be printed with the stamp characters for indication of the stamp characters, the printing device comprising:

a printing mechanism for printing the stamp characters on the character check area and the at least one indication character area;

a feeding mechanism for feeding the plate-making sheet to the printing mechanism; and a sensor for detecting feed of the plate-making sheet to the printing mechanism.

According to this printing device, the feeding mechanism is controlled according to results of detection by the sensor, whereby the stamping characters can be accurately printed at a desired location on the plate-making sheet, that is, on a label portion.

Preferably, the printing mechanism simultaneously carries out printing on the character check area and printing on a mask for use in making the stamp.

According to this preferred embodiment, stamp characters to be engraved on the stamping face of the stamp and an image of stamp characters for checking on the stamp characters can be printed in quite the same size and typeface.

Preferably, an image of the stamp characters printed on the character check area is identical in typeface with but different in boldness from an image of the stamp characters printed on the at least one indication character area.

According to this preferred embodiment, stamp characters affixed to (indicated on) the back surface of the stamp can be printed as a faithful reproduction of an imprint of the stamp characters of the stamp or as an image of the stamp characters formed with preference to legibility.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof. In the embodiment, a plate-making sheet and a printing device for printing on the plate-making sheet, according to the invention, are applied to a stamp making apparatus for making stamps. The stamp making apparatus makes a desired stamp by exposing a stamp unit (stamp-making material) having a stamping face-forming portion made of ultraviolet-curing resin to ultraviolet rays via a mask of an ink ribbon printed with stamp characters i.e. a stamp image including images of characters and figures. A printing operation on the ink ribbon is carried out simultaneously with a printing.operation on the plate-making sheet (by transfer of ink from the ink ribbon to the plate-making sheet). The plate-making sheet printed with the stamp characters is used not only for checking on the printed stamp characters, but also for making a stamp character label by peeling the printed portion off the sheet, which is affixed to the back surface of the stamp created by using the ink ribbon.

Figure 1:
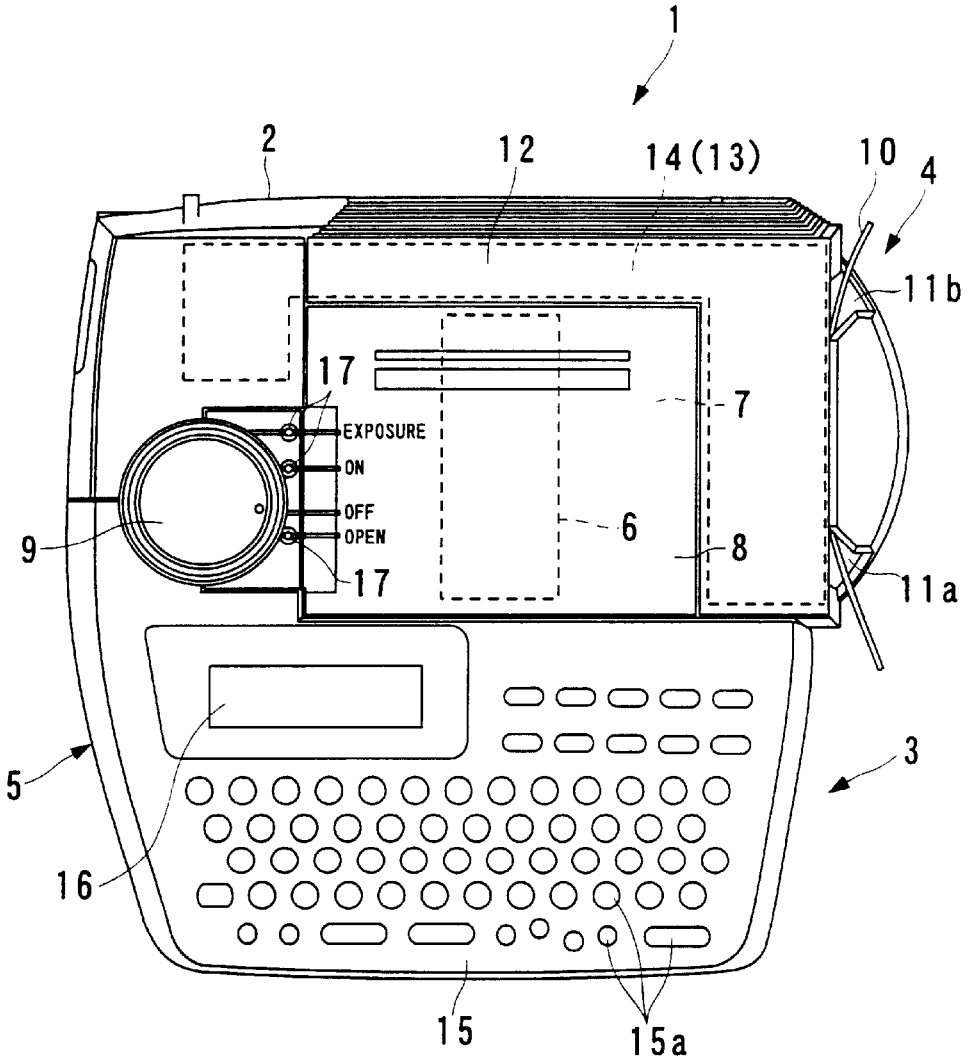
FIG. 1 is a plan view of a stamp making apparatus according to an embodiment of the invention.
Figure 2:
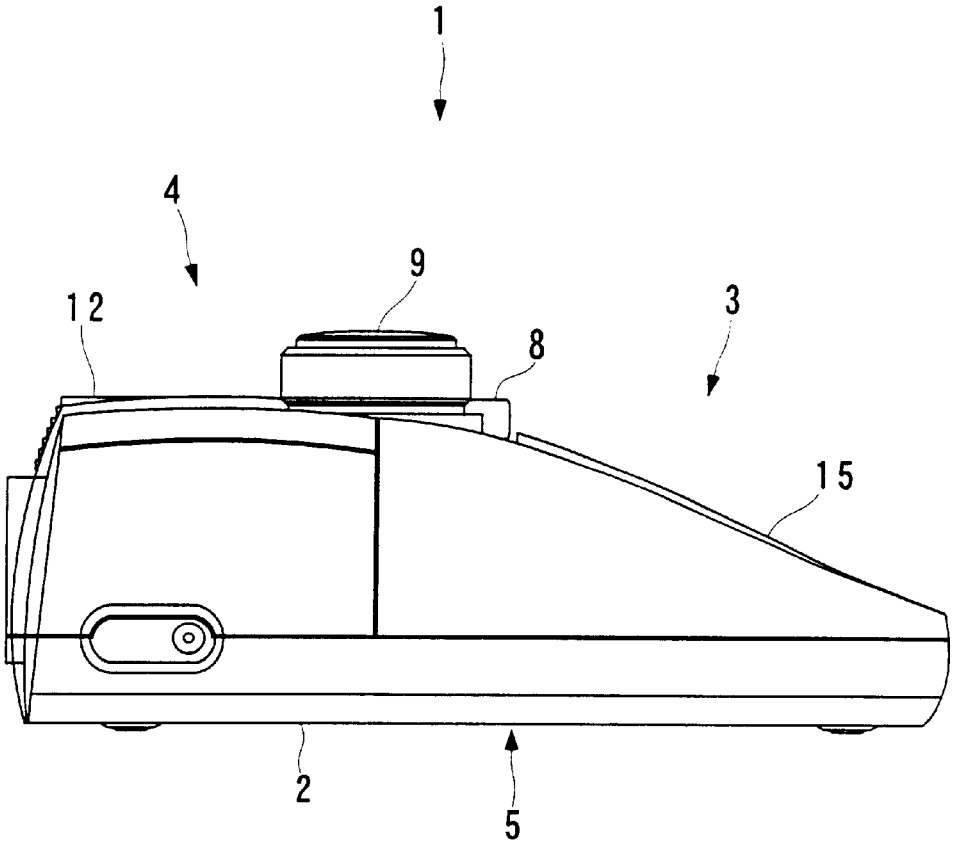
FIG. 2 is a side view of the stamp making apparatus according to the embodiment.

FIG. 1 is a plan view of the stamp making apparatus, and FIG. 2 is a side view of the same. As shown in the figures, the stamp making apparatus 1 includes a casing 2 having upper and lower divisional portions, an electronic block 3 arranged in a front part of the casing 2, and a mechanical block 4 arranged in a rear part of the same. In a central area of the mechanical block 4, there is formed a compartment 7 for receiving a stamp unit 6 in a body 5 of the apparatus, and a lid 8 formed with a window is provided for opening and closing the compartment 7. In a left side portion of the mechanical block 4 as viewed in FIG. 1, a function switch 9 is provided for switching the operation of the stamp making apparatus 1 e.g. to plate-making (printing) or exposure, as well as for opening the lid 8. Further, in a right side portion of the mechanical block 4, there are formed an inserting slot 11*a* for inserting a plate-making sheet 10 into the stamp making apparatus 1 from outside, and a take-out slot 11*b* for taking out the plate-making sheet 10 therefrom. Further, the mechanical block 4 has a maintenance cover 12 removably mounted on part thereof around the compartment 7, and an ink ribbon cartridge 14 carrying an ink ribbon 13 is mounted under the maintenance cover 12.

The electronic block 3 has a keyboard 15 arranged in a top thereof and a display 16 arranged in an upper left-side portion of the top adjacent to the keyboard 15. The keyboard 15 includes various kinds of entry keys 15*a*. The electronic block 3 contains an information processing system as a main component thereof, while the mechanical block 4 contains a feeder for feeding the ink ribbon 13 and the plate-making sheet 10, a printing device, and an exposure device for exposing the stamp unit 6 to ultraviolet rays.

Now, a sequence of operations for making a stamp will be briefly described with reference to FIGS. 1 and 2. First, the function switch 9 is operated to open the lid 8, and the stamp unit 6 is set in the compartment 7. As the stamp unit 6 is set, the type of the stamp unit 6 is detected by a detecting device 31, described hereinafter. And, based on the detected type of the stamp unit 6, the information processing system controls an input block and an output block thereof. Then, the user operates the function switch 9 to shift the function of the apparatus to plate-making, and operates the keys 15*a* of the keyboard 15 to input desired stamp characters while watching the display 16. When the inputting of stamp characters is completed, the plate-making sheet 10 is. set by inserting.the same into the inserting slot 11*a*.

Then, a predetermined key 15*a* on the keyboard 15 is operated to cause the apparatus to execute a plate-making operation, i.e. printing of the stamp characters. The printing is effected simultaneously on the ink ribbon 13 and the plate-making sheet 10 by feeding the ink ribbon 13 and the plate-making sheet 10. When the printing is completed, (the printed portion of) the ink ribbon 13 is advanced to set the same for exposure to ultraviolet rays, and at the same time the plate-making sheet 10 is discharged from the take-out slot 11*b*. When it is confirmed by the discharged plate-making sheet 10 that there is no error in the printed stamp characters, the function switch 9 is operated to shift the function of the apparatus to exposure, thereby causing the apparatus to perform exposure of the stamp unit 6 to ultraviolet rays over a predetermined time period.

When the exposure to ultraviolet rays is completed, the function switch 9 is operated to open the lid 8, and then the stamp unit 6 is removed from the compartment 7 to wash the same such that an uncured portion thereof is raked out. The washing completes the stamp. Before or after completion of the stamp, the stamp character label is peeled off the plate-making sheet 10 to affix the same to the back surface of the stamp. It should be noted that the stamp unit 6 includes various types having respective different shapes, e.g. ones for a business stamp, an address stamp, etc.

Next, the stamp unit 6 and the plate-making sheet 10 for use with the stamp making apparatus 1 will be described in relation to component devices of the apparatus.

The function switch 9 arranged in the mechanical block 4 can be rotated clockwise from an "OFF" position as a standby position to an "OPEN" position or counterclockwise from the "OFF" position to an "ON" position, and further to an "EXPOSURE" position. In the "OPEN" position, the lid 8 provided on the compartment 7 is popped up to receive the stamp unit 6 in the compartment 7 or allow removal of the same therefrom, and in the "ON" position, a data entry and the plate-making are carried out via the keyboard 15 and by the printing device 23, while in the "EXPOSURE" position, the exposure of the stamp unit 6 to ultraviolet rays is executed by the exposure device 26. The function switch 9 also serves as an electrical switch for switching between indications of modes of the apparatus. When the function switch 9 is operated or switched to one of the above-mentioned positions, a corresponding one of indicator lamps 17 (no indicator lamp for the "OFF" position) provided along the periphery of the function switch 9 is lighted to indicate the selected position.

Figure 3:
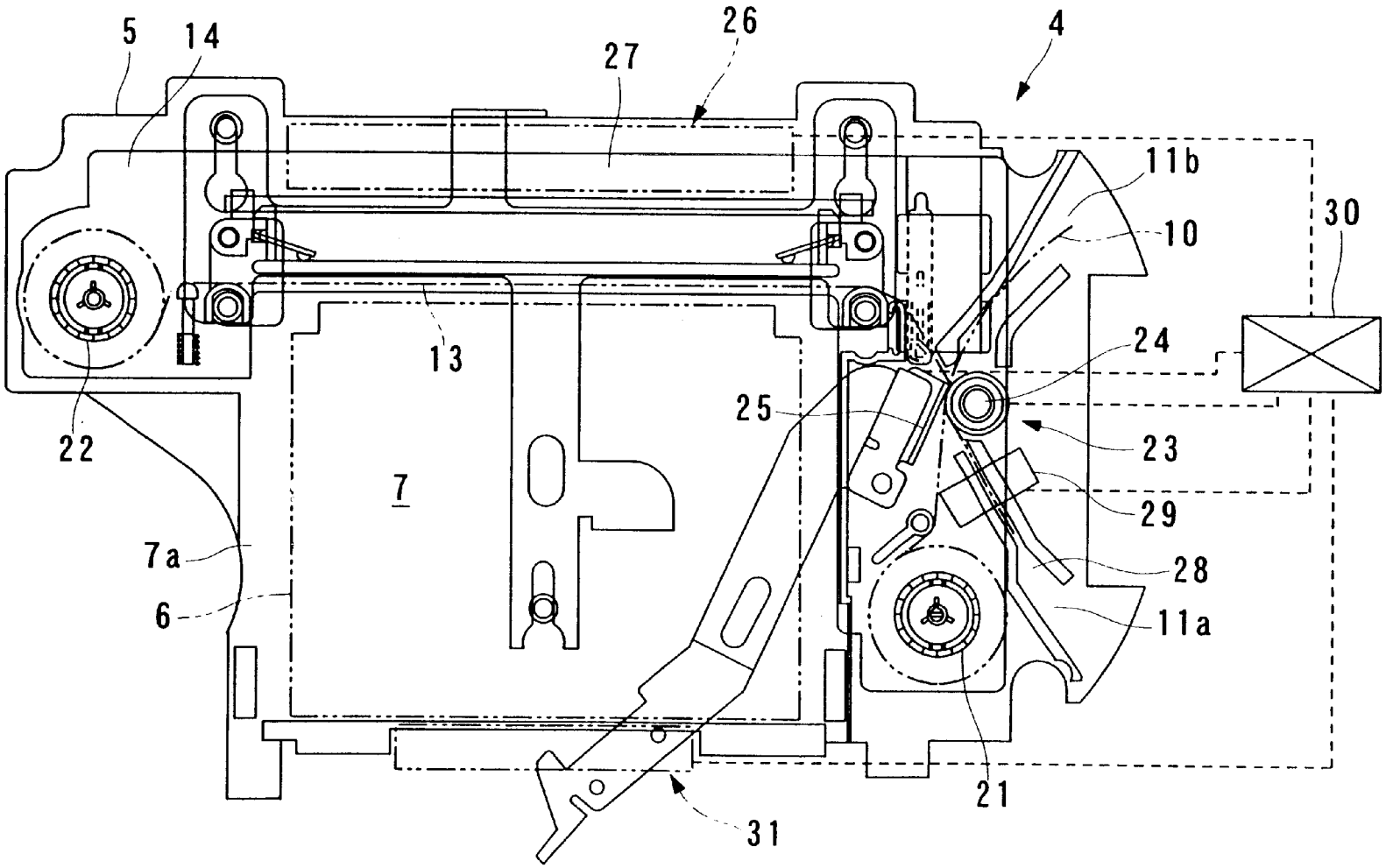
FIG. 3 is a plan view of an internal construction of a mechanical block of the stamp making apparatus.

The ribbon cartridge 14 is constructed such that it is removable from the apparatus body 5, and it is replaceable together with a casing thereof when the ink ribbon 13 is used up. As shown in FIG. 3, the ribbon cartridge 14 has a take-up reel 22 arranged at one end thereof and a supply reel 21 arranged at the other end thereof. The ink ribbon 13 is rolled out from the supply reel 21, fed along a generally mirrored L-shaped feed path, and taken up by the take-up reel 22.

The mirrored L-shaped feed path has a shorter side portion which the printing device 23 including a platen 24 and a print head 25 faces, and a longer side portion which the exposure device 26 having an ultraviolet ray source 27 faces. The printing device 23 faces the ink ribbon 13 and the plate-making sheet 10 simultaneously, and the exposure device 26 faces the ink ribbon 13 printed with the stamp characters. Further, on a feeding passage 28 continuous with the inserting slot 11*a* faces a sensor 29 which detects insertion of the plate-making sheet 10 and a feeding reference position of the same. The plate-making sheet 10 inserted into the feeding passage 28 is sent forward by the platen 24 depending on results of the detection by the sensor 29, whereby printing is carried out by the print head 25. The platen 24 serves as part of the feeder, and a motor, not shown, of the feeder, the print head 25, the ultraviolet ray source 27 and the sensor 29 are connected to a controller 30. The detecting device 31 for detecting the stamp unit 6 is arranged at a location opposed to the exposure device 26 via the compartment 7. The detecting device 31 is also connected to the controller 30.

The ink ribbon 13 is comprised of a transparent ribbon tape, and ink coated thereon. In the present embodiment, it has a thickness of 6 $\mu$m. When the printing device 23 of the apparatus prints a character on the ink ribbon 13, a portion of ink coated on the ink ribbon, which defines the character, is transferred to the plate-making sheet 10, whereby the ribbon tape of the ink ribbon 13 is caused to bear a negative image defined by a transparent portion from which the portion of ink defining the character has been transferred, while the plate-making sheet 10 is caused to bear a positive image defined by the transferred portion of ink defining the character. The printing device 23 prints main stamp characters to form a negative image on the ink ribbon 13 which is used as the mask in carrying out the exposure, and auxiliary stamp characters which are different from the main stamp characters only in that they are bolder in print than the corresponding main stamp characters, respectively (see FIG. 4). The portion of the ink ribbon 13 bearing the negative image of the main stamp characters is brought to the exposure device 26 to use the same as the mask for exposure. On the other hand, the portion of the plate-making sheet 10 printed with the main stamp characters 43*a,* i.e. bearing the positive image thereof, is used for the user to check on the stamp characters, while the portion of the plate-making sheet 10 printed with the auxiliary stamp characters 44*a* is for being affixed to the back surface of a stamp thus made (see FIG. 4).

Next, the construction of the plate-making sheet 10 and the relationship between the plate-making sheet 10, the printing device 23 and the sensor 29 will be described in detail. There are provided a plurality of kinds of plate-making sheet 10 corresponding to several kinds of stamps (stamp unit 6), which are largely classified into two types (although outer shapes of all the kinds are identical to each other), one for large stamps including a business stamp and an address stamp, and one for small stamps including an unregistered personal stamp (seal) and an accounting stamp (see FIGS. 10 to 13). Here, only the, plate-making sheet 10 for small stamps is described, and description of the plate-making sheet for large stamps will be omitted. It should be noted that the plate-making sheet 10 for small stamps includes ones for the unregistered personal stamp, an unregistered personal stamp (small), a square stamp (small), and the accounting stamp, as shown in FIGS. 4 to 7.

Figure 4:
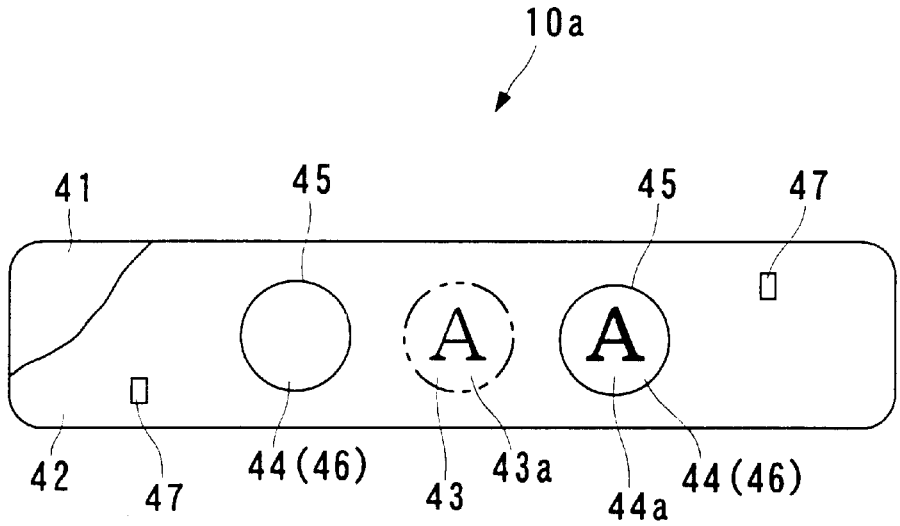
FIG. 4 is a plan view, partly broken, of a plate-making sheet for an unregistered personal stamp which is printed with images of a character.

FIG. 4 shows a plate-making sheet 10*a* for the unregistered personal stamp. As shown in the figure, the plate-making sheet 10*a* is formed of laminated of a base sheet (backing sheet) 41 and an adhesive sheet 42, generally in the form of a strip. The central part of the adhesive sheet 42 is formed with a character check area 43 to be printed with the main stamp character 43*a,* and opposite sides of the character check area 43 are provided a pair of indication character areas 44, 44 to be printed with the auxiliary stamp characters 44*a*. The indication character areas 44, 44 are each defined by a circular cutting line 45, and stamp character labels 46 are each formed by the cutting line 45. That is, a circular portion of the adhesive sheet 42, which is peeled off the base sheet 41 along the cutting line 45, forms a stamp character label 46 to be affixed to the back surface of the unregistered personal stamp.

In this embodiment, the center of the character check area 43 coincides with the center of the plate-making sheet 10*a,* while the pair of indication character areas 44, 44 are arranged at diametrically opposite or centrosymmetric locations with respect to the center of the sheet. In other words, the main stamp characters 43a used for checking on the stamp characters are printed in the center of the plate-making sheet 10*a,* and a mask portion of the ink ribbon 13 corresponding to the main stamp characters 43*a* is sent by a predetermined distance to position the same at the center of the exposure device 26. Although the auxiliary stamp characters 44*a* are printed in only one of the pair of indication character areas 44, 44, the pair of indication character areas 44, 44 are provided for the user to insert the plate-making sheet without considering a forward end side or a rearward end side of the sheet.

Although the main stamp characters 43*a* and the auxiliary stamp characters 44*a* are printed in the same typeface, the auxiliary stamp characters 44*a.* are printed in bolder print. This causes an imprint of the stamp characters made by pressing the completed unregistered personal stamp to be identical in boldness to the stamp characters (auxiliary stamp characters 44*a*) printed on the stamp character label 46 affixed to the back surface of the unregistered personal stamp. As a result, the user does not feel a sense of disagreement between the printed image of the stamp characters on the back surface of the stamp and an imprint of the stamp characters made by pressing the stamp, and can easily read the stamp characters on the back surface of the stamp. It should be noted that stamp characters different in boldness may be printed in the respective indication character areas 44, 44 so as to permit the user to select and use one of them as the stamp character label 46. Further, it is possible to increase the number of indication character areas 44 to be printed with stamp characters different in boldness, thereby providing the user more alternatives for selection of a stamp character label 46.

On the other hand, the plate-making sheet 10*a* has a pair of through holes 47, 47 formed between the stamp character label 46 and outer ends of the sheet at diametrically opposite or centrosymmetric locations with respect to the center of the sheet. The through holes 47 are arranged at respective locations closer to the opposite longer sides of the plate-making sheet 10*a* and substantially square-shaped. Similarly to the pair of indication character areas 44, 44, the through holes 47, 47 are provided in pair to prevent a forward end side and a rearward end side from being set to the plate-making sheet 10*a*. Further, since the through holes 47 are arranged at the respective locations closer to the longer sides of the plate-making sheet 10*a,* it is possible to discriminate between the front and the back of the inserted plate-making sheet 10*a,* which will be described in detail hereinafter.

The plate-making sheet 10 is inserted along the longer side thereof. As shown in FIG. 3, when the plate-making sheet 10 is inserted into the feeding passage 28, the sensor 29 first detects a leading end of the plate-making sheet 10, and then one of the through holes 47. The sensor 29 is formed of an optical sensor, such as a photo interrupter. When the leading end of the plate-making sheet 10 is brought to a light path of the sensor 29 to interrupt the light emitted from the sensor 29, the presence of the plate-making sheet 10 is detected, and then, when a through hole 47 of plate-making sheet 10 is brought to the light path to allow the light to be transmitted therethrough, the presence of the through hole 47 is detected.

When the presence of the plate-making sheet 10 is. detected, the controller 30 causes the platen 24 to start rotating, thereby starting feed of the plate-making sheet 10 inserted. Then, the plate-making sheet 10 is fed by a predetermined range of numbers of steps (for a predetermined range of time). If the presence of the through hole 47 is detected by this feed of the plate-making sheet 10, it is determined that the plate-making sheet 10 is properly set with its top surface and underside surface on the proper sides, and after the plate-making sheet 10 is advanced by several steps from a position where the through hole 47 was detected, printing by the print head 25 is started. In this process, when the plate-making sheet 10 is fed by the predetermined range of numbers of steps (for the predetermined range of time), if the presence of the through hole 47 cannot be detected, it is determined that the plate-making sheet 10 is inserted with its top surface and underside surface on the wrong sides and the platen 24 is temporarily stopped from rotating and an alarm is generated. Thereafter, the printing operation is canceled to discharge the plate-making sheet 10 from the take-out slot 11*b*. Further, a print-starting position depends on the size or position of the stamp character label 46, that is, the type of the plate-making sheet 10. Therefore, the controller 30 calculates the print-starting position from character data entered, and based on a result of the calculation, causes the plate-making sheet 10 to be fed by several steps from the position where the through hole 47 was detected, followed by causing the print head 25 to start printing.

It should be noted that the base sheet 41 and the adhesive sheet 42 may be caused to have an achromatic color and a chromatic color, respectively, to thereby make the top surface and the underside surface of the plate-making sheet 10 readily distinguishable from each other. Further, the chromatic color for the adhesive sheet 42 may be varied according to the kind of the plate-making sheet 10 for easy detection of the kind thereof.

Figure 5:
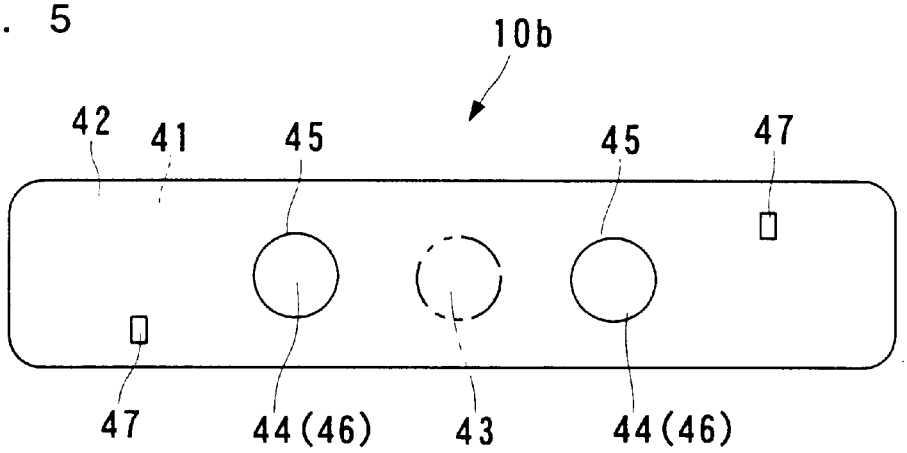
FIG. 5 is a plan view of a plate-making sheet for an unregistered personal stamp (small)
Figure 6:
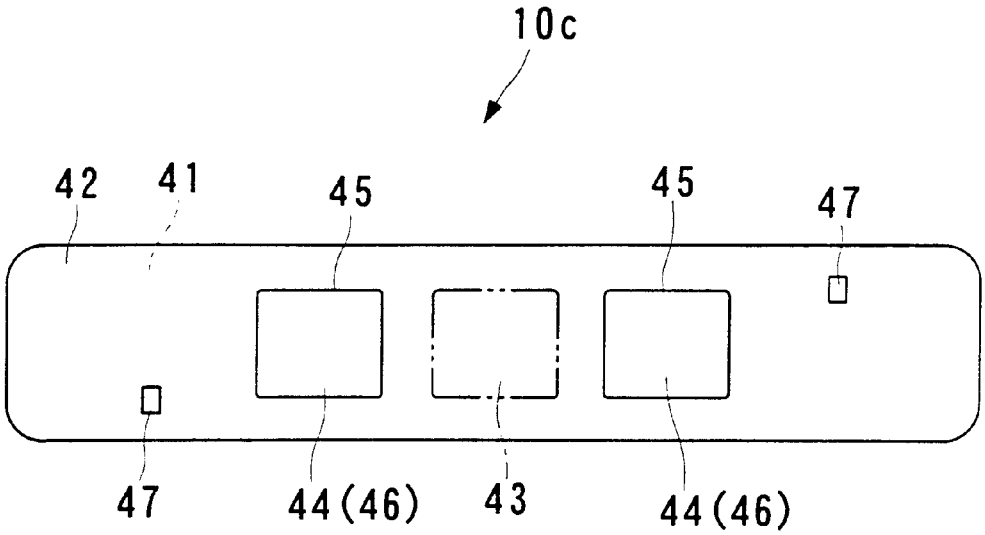
FIG. 6 is a plan view of a plate-making sheet for a square stamp (small)
Figure 7:
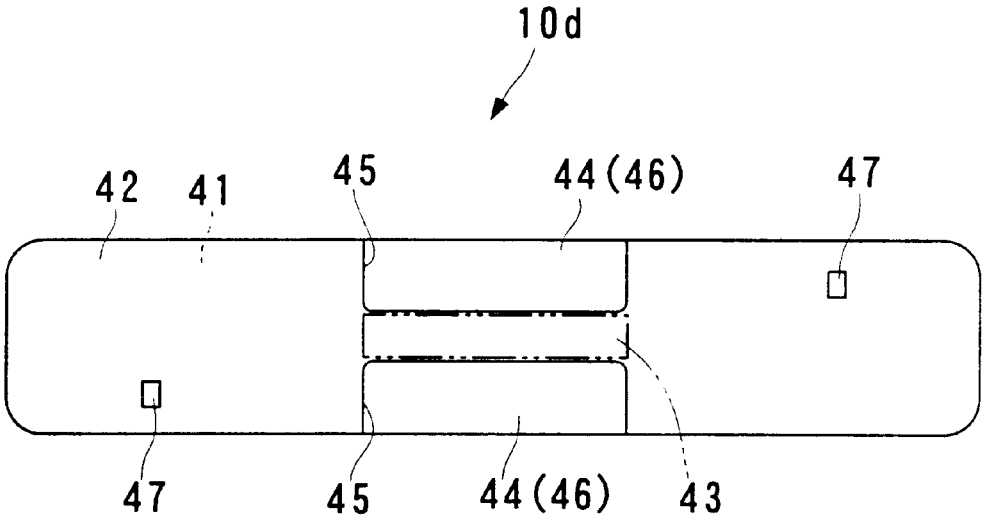
FIG. 7 is a plan view of a plate-making sheet for an accounting stamp.

FIG. 5 shows a plate-making sheet 10*b* for the unregistered personal stamp (small). FIG. 6 shows a plate-making sheet 10*c* for the square stamp (small). FIG. 7 shows a plate-making sheet 10*d* for the accounting stamp. The plate-making sheets 10*b,* 10*c* shown in FIGS. 5 and 6 have the same basic construction as that of the FIG. 4 plate-making sheet 10*a,* and only the stamp character label 46 thereof is varied from that of the FIG. 4 plate-making sheet 10*a* to suit the shape of the back of a corresponding stamp. Further, the FIG. 7 plate-making sheet 10*d* for the accounting stamp has a pair of stamp character labels (indication character areas 44) 46, 46 formed at upper and lower locations on opposite sides of the character check area 43 as viewed in the figure. When the stamp unit 6 has a stamping face having an elongated shape small in width, it is possible to arrange a pair of stamp character labels 46, 46 in the above manner, i.e. at respective upper and lower locations in the direction of width of the plate-making sheet. Further, the stamp character label 46 has a width larger than that of the back surface of the accounting stamp (stamp unit 6), and hence it is affixed in a manner covering the back surface and part of the bottom adjacent thereto.

Next, the stamp unit 6 will be described. Before description thereof, the structure of the compartment 7 in which the stamp unit 6 is mounted and the detecting device 31 for use with the stamp unit 6 will be described with reference to FIGS. 8 and 9.

These figures show the stamp unit 6 for a large stamp in a state mounted in the compartment 7. The. exposure device 26 is opposed to the stamping surface of the stamp unit 6 i.e. located in front of the stamp unit 6 mounted, while the detecting device 31 is opposed to the back surface of the stamp unit 6 i.e. located at the back of the same, to detect the type of the stamp unit 6 and the mounting and removal of the same. The stamp unit 6 is mounted in the compartment 7 such that for any type of stamp unit 6, an imaginary center line of the stamp unit 6 which is central in the direction of width of the stamp unit 6 and an imaginary center line of the same which is central in the direction of the thickness of same are brought to identical positions within the compartment 7. The positioning of the stamp unit 6 in the compartment 7 is effected by fitting a plurality of bosses (support projections) 51*a,* 51*b,* 52, 52 extending upright from the bottom 7*a* of the compartment 7 in a plurality of boss holes (positioning holes) 77*a,* 77*b,* 79, 79 referred to hereinafter, formed in the bottom of the stamp unit 6 (the underside of the same in the mounted state), respectively.

Figure 8:
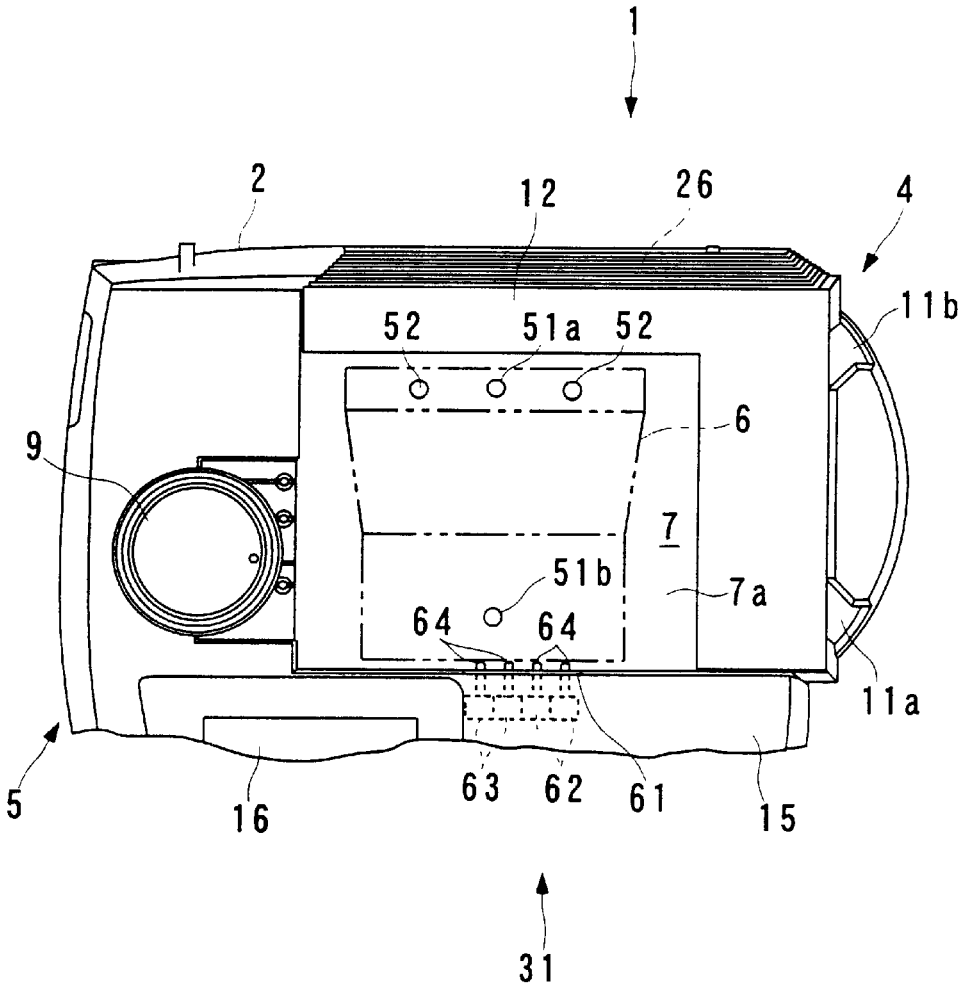
FIG. 8 is a plan view showing the construction of a compartment of the stamp making apparatus.
Figure 9:
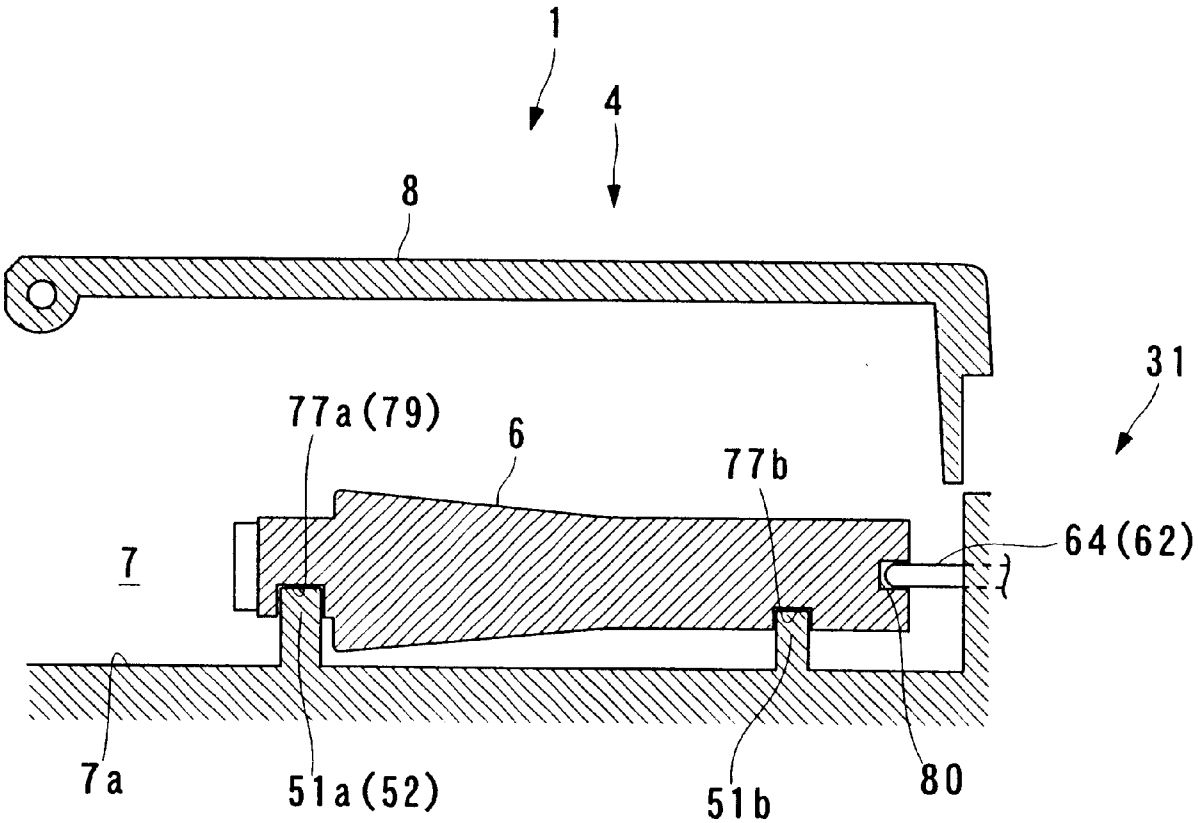
FIG. 9 is a cross-sectional view of a stamp unit for a large stamp, in a state mounted in the compartment.

As shown in FIGS. 8 and 9, on the bottom, 7*a* of the compartment 7, there are provided two main support bosses 51*a,* 51*b* extending upright at respective locations on the imaginary center line on the bottom 7*a* of the compartment 7 which is substantially central in the direction of width of the compartment 7 (in the left-to-right direction as viewed in FIG. 8), and a pair of auxiliary support bosses 52, 52 extending upright at respective locations on opposite sides of the main support boss 51*a* on the exposure device 26 side in line symmetry with respect to the imaginary center line. That is, the main and auxiliary support bosses 51*a,* 51*b,* 52, 52, four in total, and each having a cylindrical shape, are generally in the T-shaped arrangement, and support the stamp unit 6 in position within the compartment 7. The main support bosses 51*a,* 51*b* form main means for supporting the stamp unit 6. The main support boss 51*a* on the exposure device side and the main support boss 51*b* on the detecting device side are formed to have respective different diameters to thereby prevent the stamp unit 6 from being mounted in an inverted direction.

Further, the back surface of the stamp unit 6 has a plurality of small holes 80 formed therein side by side at respective locations which are central in the direction of thickness of the stamp unit 6 (in the direction of height of the same in the mounted state). Through cooperation of the small holes 80 with four detecting switches 62 of the detecting device 31, the type of the stamp unit 6 is detected. More specifically, each type of the stamp unit 6 has its particular variation of positions and presence or absence of small holes 80 formed in the back surface of the stamp unit 6, and the detecting device 31 detects this variation.

The detecting device 31 is comprised of a switch holder 61 (also serving as a wall of the compartment 7) arranged such that it is opposed to the back surface of the stamp unit 6 mounted in the compartment 7, and the four detecting switches 62 supported on the switch holder 61. Each detecting switch 62 is comprised of a switch 63 formed e.g. by a push switch, and a switch top 64 arranged such that its end can advance i.e. project into and recede i.e. retract from the compartment 7. All the switch tops 64 advance in accordance with the closing operation of the lid 8 and each abut against the back surface of the stamp unit 6 or not depending on the type of the stamp unit 6.

That is, the detecting switches 62 are each in an ON or OFF state depending on whether corresponding small holes 80 exist in the stamp unit 6. Therefore, the type of the stamp unit 6 can be determined from a pattern of ON/OFF states.of the four detecting switches 62. Further, when any of the detecting switches 62 is turned on (or off in a different configuration), mounting of the stamp unit 6 is detected, whereas when all of the detecting switches 62 are turned off (or on in the different configuration), removal of the stamp unit 6 is detected.

Next, the stamp unit 6 will be described with reference to FIGS. 10 to 14. Here, only the stamp unit for a small stamp will be described, and description of the stamp unit for a large stamp will be omitted.

Figure 10:
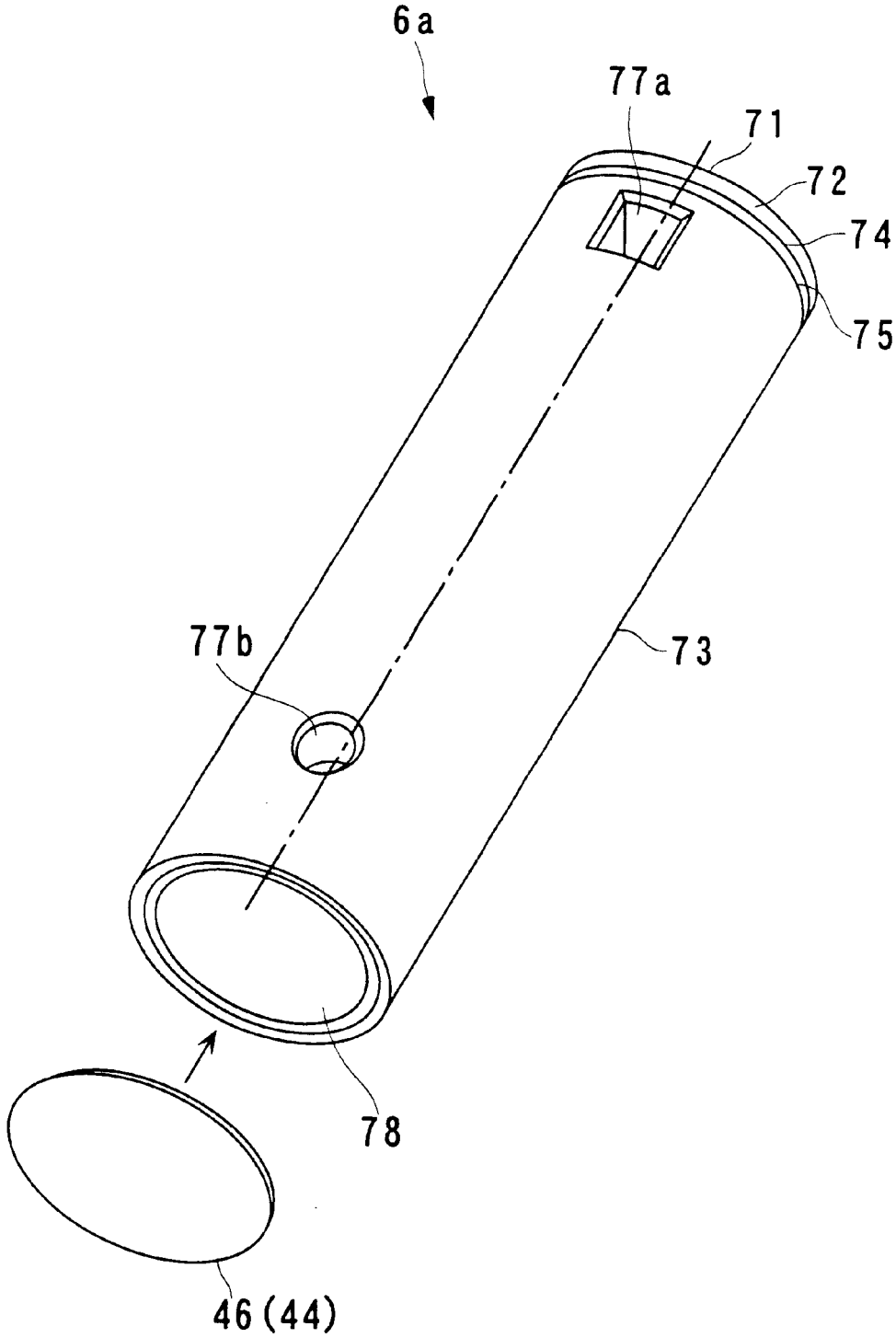
FIG. 10 is a perspective view of an appearance of a stamp unit for the unregistered personal stamp.

FIG. 10 shows a stamp unit 6*a* for the unregistered personal stamp. As shown in the figure, the stamp unit 6*a* is comprised of a stamping face material block 71 having a stamping face-forming portion formed of an ultraviolet-curing resin 72, and a stock (made of resin in the present embodiment) 73 for holding the material block 71. The material block 71 is formed of a laminate of the ultraviolet-curing resin 72, a resin base 74, and a sponge 75, and has the sponge 75 affixed to a stamp front-side surface of the stock 73. The ultraviolet-curing resin 72 forms an area on which stamp characters are engraved, and receives ultraviolet rays from the exposure device 26 via a mask, for being cured to form shapes of the characters. The resin base 74 is formed of an ultraviolet-insensitive film or the like. The sponge 75 provides a cushioning effect to realize soft touch stamping, when the stamp is used. Further, on the stamp front end of the stock 73 is fitted a cap, not shown, for covering the material block 71, which prevents the material block 71 from being exposed before the stamp unit 7 is mounted in the stamp making apparatus 1.

The stock 73 has a periphery thereof formed with a stamp front-side boss hole 77*a* and a stamp rear-side boss hole 77*b* engaging with the main support boss 51*a* and the main support boss 51*b,* respectively. The stamp rear-side boss hole 77*b* is a circular hole (strictly, an elliptic hole), whereas the stamp front-side boss hole 77*a* is a square hole, which permits the main support boss 51*a* in a cylindrical form to be easily fitted therein without spoiling the accuracy of positioning of the stamp unit 6*a* effected thereby. As described above, the stamp front-side boss hole 77*a* and the stamp rear-side boss hole 77*b* mainly effect the positioning of the stamp unit 6 in the directions of the length and width thereof, and the depths of the stamp front-side boss hole 77*a* and the stamp rear-side boss hole 77*b* effects positioning of the stamp unit 6 in the direction of the thickness thereof (in the direction of height of the stamp unit in the mounted state).

The stamp front-side boss hole 77*a* and the stamp rear-side boss hole 77*b* are formed in parallel with the central axis of the stamp unit 6*a* in a manner slightly offset from the axis in the direction of the width of the stamp unit 6*a.* This makes it possible to detect the type of the stamp unit 6*a* with accuracy, as will be described in detail hereinbelow. Further, the stock 73 has a label-affixing portion 78 as a slightly recessed portion formed in the back surface of the stock 73. To the label-affixing portion 78 is affixed the stamp character label 46 printed with the auxiliary stamp characters 44*a.*

Figure 11:
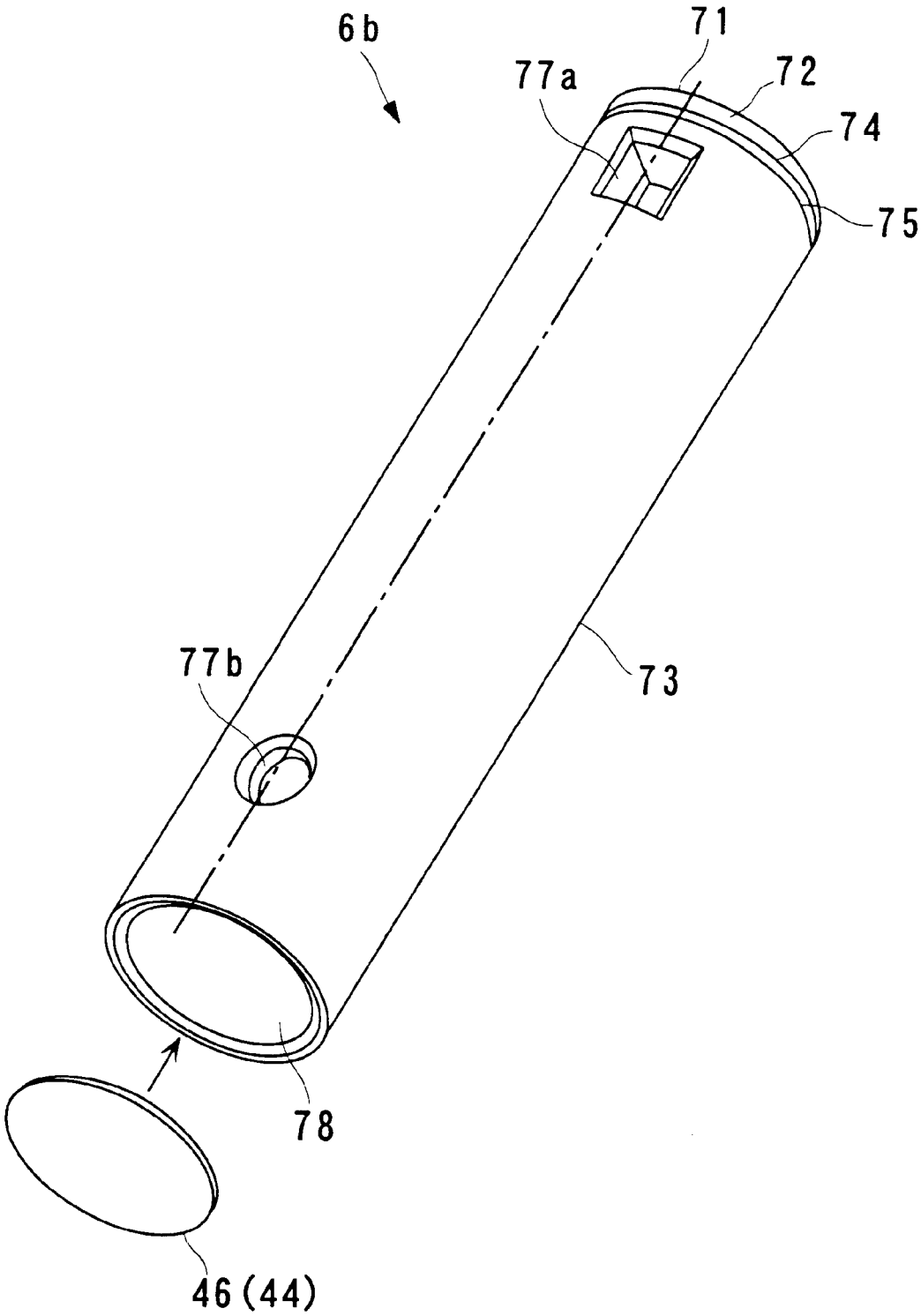
FIG. 11 is a perspective view of an appearance of a stamp unit for the unregistered personal stamp (small)
Figure 12:
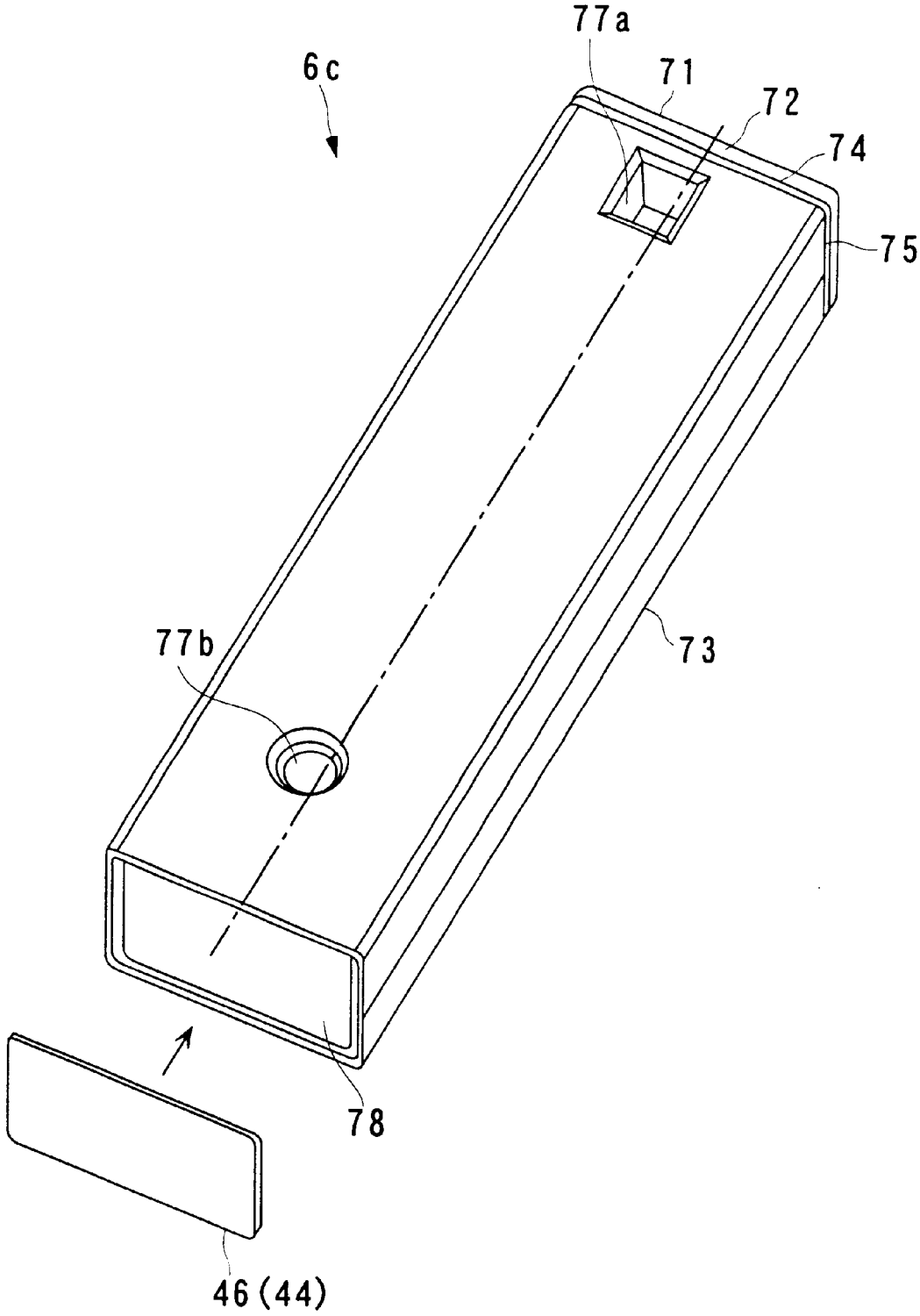
FIG. 12 is a perspective view of an appearance of a stamp unit for the square stamp (small)
Figure 13:
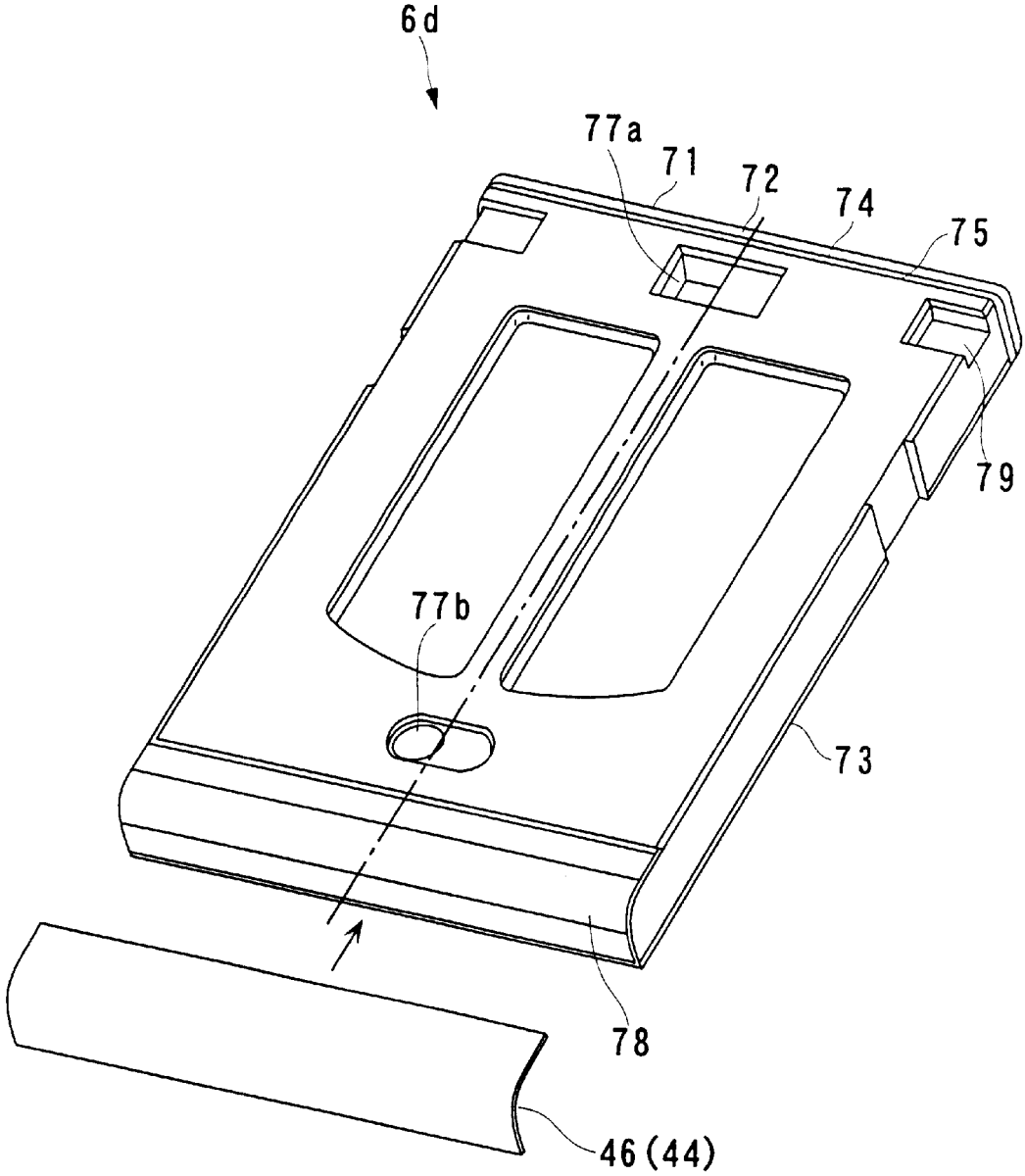
FIG. 13 is a perspective view of an appearance of a stamp unit for the accounting stamp.

FIG. 11 shows a stamp unit 6b for the unregistered personal stamp (small). FIG. 12 shows a stamp unit 6*c* for the square stamp (small), and FIG. 13 shows a stamp unit 6*d* for the accounting stamp. Although the stamp units 6*b,* 6*c,* 6*d* are different in shape from each other, they are all comprised of a stamping face material block 71 and a stock 73. The stock 73 is formed with a stamp front-side boss hole 77*a* and a stamp rear-side boss hole 77*b* as well as a label-affixing portion 78. In the stamp units 6*c,* 6*d* in FIGS. 12 and 13, similarly to the case of the FIG. 10 stamp unit 6*a,* their stamp front-side:and stamp rear-side boss holes 77*a,* 77*b* are arranged in a manner offset from the central axes of the stamp units in the direction of the widths thereof, but the FIG. 11 stamp unit 6*b* has its stamp front-side and stamp rear-side boss holes 77*a,* 77*b* located on the central axis of the unit without being offset from the same, as will be described in detail hereinafter.

Further, the FIG. 13 stamp unit 6*d* is formed with auxiliary boss holes 79 corresponding to the respective auxiliary support bosses 52 in the compartment 7. Moreover, in this stamp unit 6*d,* the stamp front-side and stamp rear-side boss holes 77*a,* 77*b* and the auxiliary boss holes 79 are formed to be extremely shallow but adjusted in depth such that the back surface of the stamp unit 6*d* is prevented from being deviated vertically from the switch tops 64 of the detecting device 31. It should be noted that the above stamp units 6 for small stamps do not have any of the above-mentioned small detection holes 80.

Figure 14:
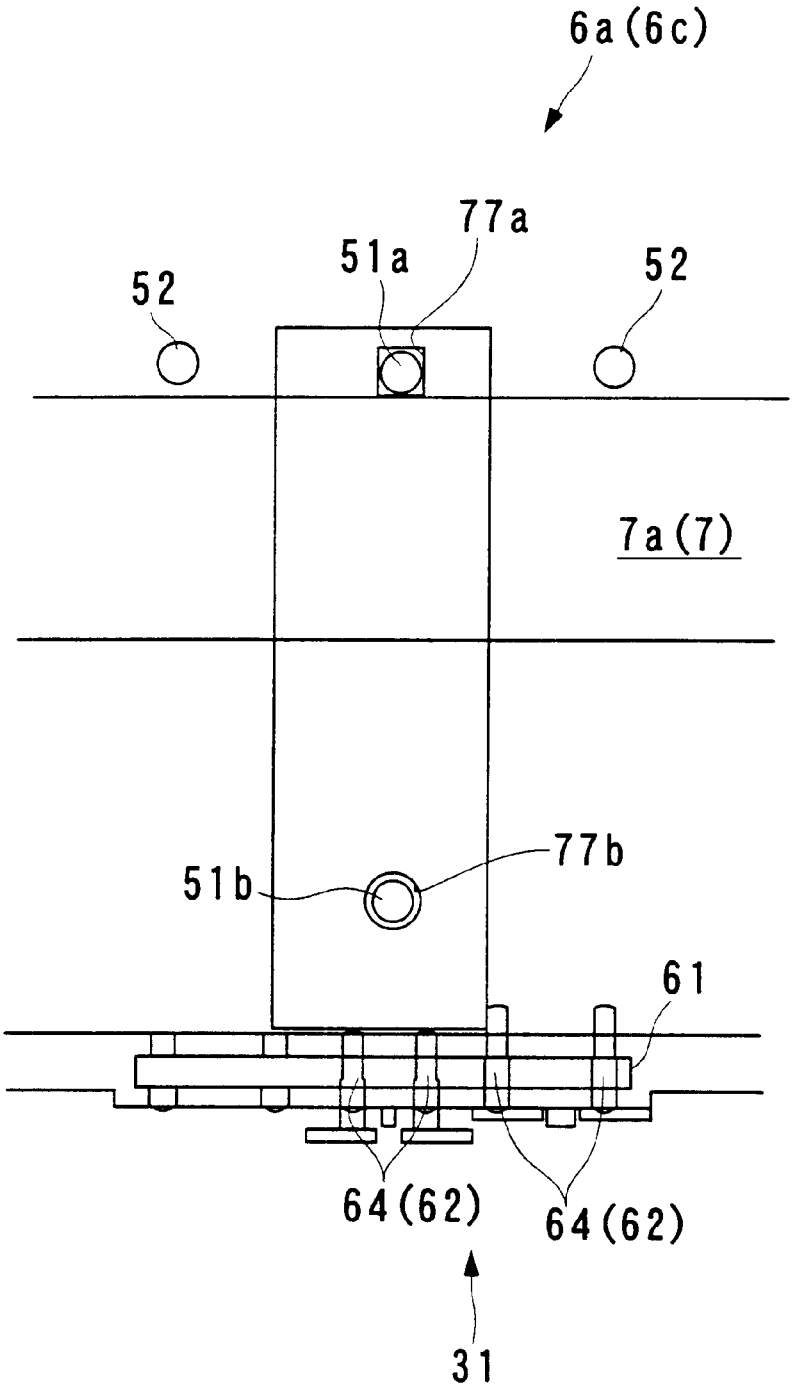
FIG. 14 is an enlarged partial plan view showing the unregistered personal stamp or the square stamp (small) mounted in the compartment.
Figure 15:
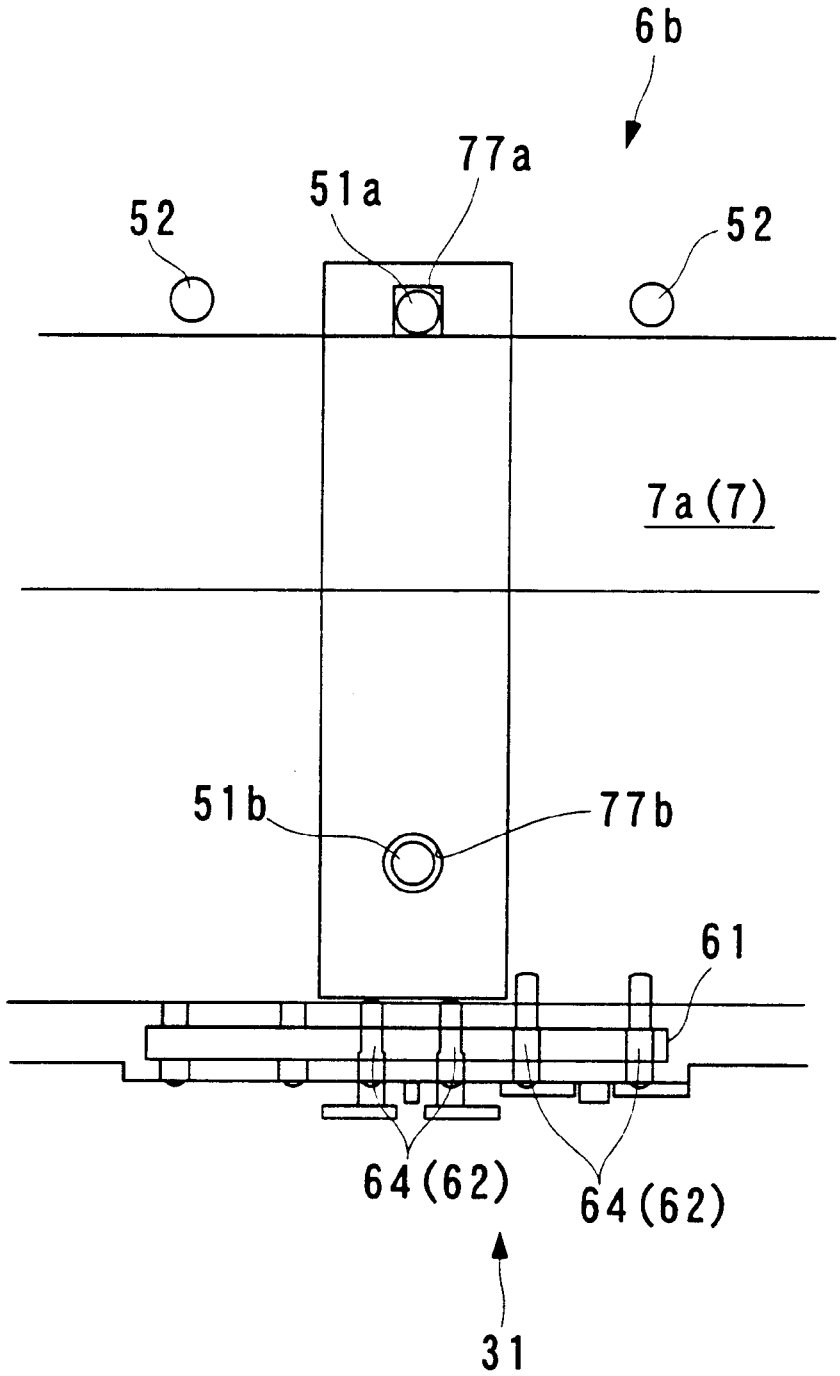
FIG. 15 is an enlarged partial plan view showing the unregistered personal stamp (small) mounted in the compartment.

Now, the positional relationship between each of the above stamp units 6 for small stamps, mounted in the compartment 7, and the detecting device 31 will be described with reference to FIGS. 14 to 16. FIG. 14 shows the stamp unit 6*a* (6*c*) for the unregistered personal stamp and the square stamp (small) in the state mounted in the compartment 7. In this stamp unit 6*a* (6*c*), the stamp front-side and stamp rear-side boss holes 77*a,* 77*b* are offset from the central axis of the stamp unit, whereby the stamp unit 6*a* (6*c*) is mounted in the compartment 7 in a manner slightly offset to the left-hand side, as viewed in the figure, in comparison with normal stamp units. This enables the stamp unit 6*a* (6*c*) to be mounted in the compartment 7 such that the mounted unit completely avoids the second switch top 64 from the right as viewed in the figure.

If the stamp front-side and stamp rear-side boss holes 77*a,* 77*b* of a stamp unit are formed without being offset from the axis of the stamp unit, an area formed by projection of the end face of the second switch top 64 and an area formed by projection of the back surface of the stamp unit 6*a* (6*c*) partially overlap each other in the left-to-rightward direction as viewed in the figure (in the direction of the width of the stamp unit), which makes the operation of the second switch top 64 unstable. In other words, there is a fear that the second switch top 64, which should be inhibited from abutting against the back surface of the stamp.unit, abuts or does not abut against the same (resulting in an ON state of the switch) depending on an manufacturing error of the stamp unit 6*a,* 6*c.* Therefore, the stamp front-side and stamp rear-side boss holes 77*a,* 77*b* are offset such that the area of the projection of the end face of the second switch top 64 is completely prevented from overlapping that of the projection of the back surface of the stamp unit 6*a* (6*c*), whereby it is possible to preclude errors in detecting the stamp unit.

Figure 16:
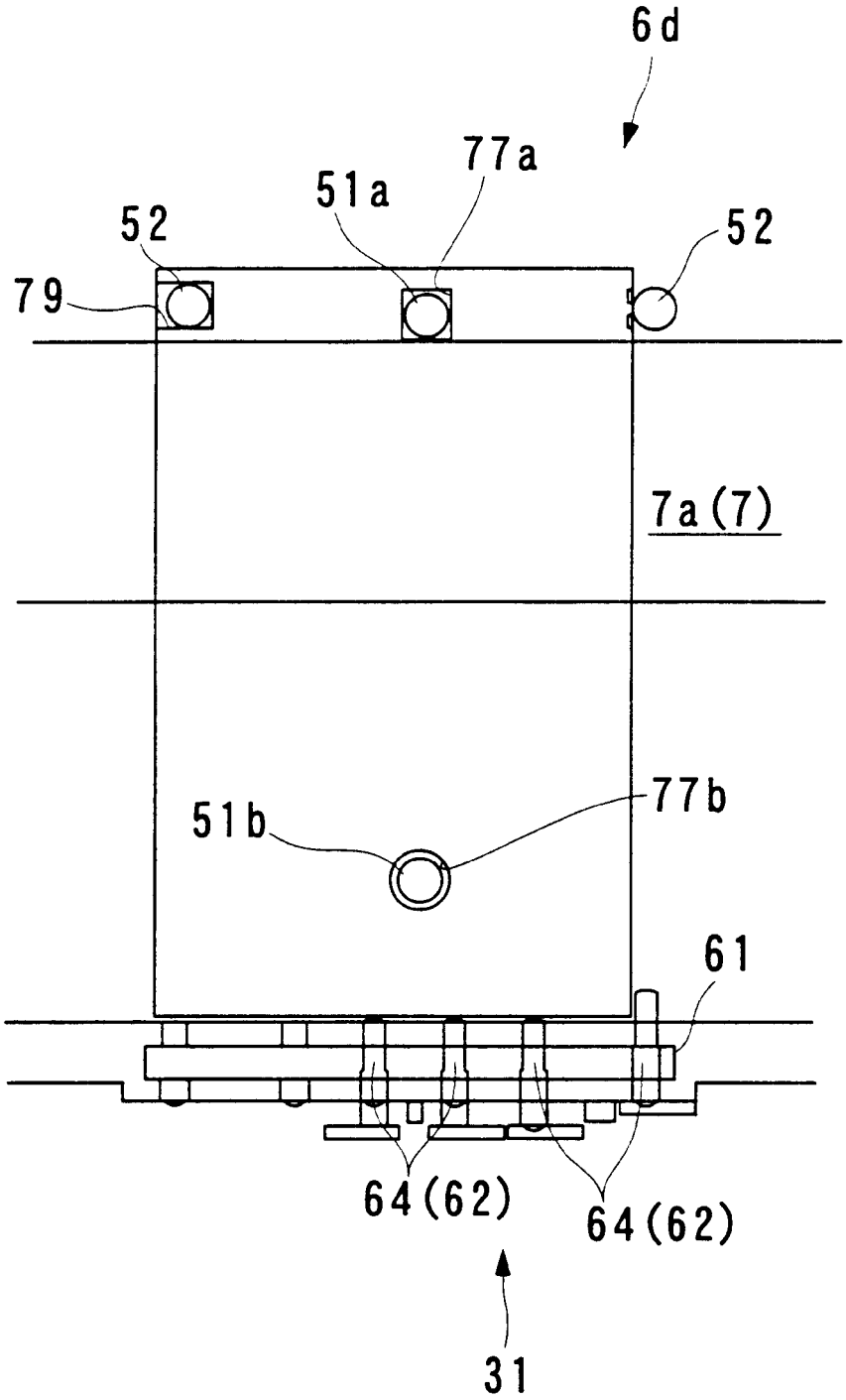
FIG. 16 is an enlarged partial plan view showing the accounting stamp mounted in the compartment.

Similarly, in the FIG. 16 stamp unit 6*d* for the accounting stamp, the stamp front-side and stamp rear-side boss holes 77*a,* 77*b* are offset to permit the stamp unit 6*d* to be mounted in the compartment 7 such that the mounted unit 6*d* completely avoids the first switch top 64 from the left. However, in the FIG. 15 stamp unit 6*b* for the unregistered personal stamp (small), the area of projection of the end face of the second or third switch top 64, 64 and that of projection of the back surface of the stamp unit 6*b* do not overlap each other even when the stamp unit 6*b* is set in its centered position, and hence the stamp front-side and stamp rear-side boss holes 77*a,* 77*b* thereof are not offset.

It should be noted that in the above configuration, the controller 30 recognizes stamp units for the unregistered personal stamp, the square stamp (small), and the unregistered personal stamp (small), as an identical stamp unit 6. Therefore, to compensate for incapability of discrimination therebetween, the stamp making apparatus 1 is configured such that menu options for the unregistered personal stamp, square stamp (small) and unregistered personal stamp (small) are displayed on the display 16 for the user to select a proper one of the options to thereby finally determine the type of the stamp unit mounted in the compartment 7. Further, when the feeding distance of the ink ribbon 13 is fixed, if stamp characters (main stamp characters 43*a*) are printed in a proper central area of the plate-making sheet 10, the location of the stamp characters on the ink ribbon as the mask in the exposure position and the location of the stamping face material block 71 of the stamp unit 6 are displaced from each other by an offset distance. In such a case, the feeding distance of the ink ribbon 13 may be increased or decreased by the offset distance, or alternatively a stamp character-printing position on the plate-making sheet 10 may be displaced from the proper central area of the sheet by the off set distance.

Although the plate-making sheet according to the above embodiments is formed by a so-called peel-off paper-backed adhesive tape, this is not limitative, but the same may be formed by a mere sheet which is not coated with an adhesive. Further, the offset of the stamp front-side and stamp rear-side boss holes of a stamp unit may be set such that the area of projection of the back surface of the stamp unit necessarily includes that of projection of the end face of a switch top even with manufacturing errors of the apparatus or the stamp unit.

As described above, according to the plate-making sheet and the printing device for printing on the plate-making sheet, according to the invention, stamp characters are printed on the plate-making sheet which includes a character check area to be printed with stamp characters for checking thereon and indication character areas to be printed with stamp characters for indication, whereby the inconvenience is eliminated that characters indicated on the back surface of a stamp are difficult to read, and at the same time the user can be prevented from feeling a sense of disagreement caused by a difference between an imprint of characters formed by the stamps and printed characters indicated on the back surface of the stamp, which makes it possible to obtain a user-friendly stamp.

It is further understood by those skilled in the art that the foregoing is a preferred embodiment of the invention, and that various changes and modifications may be made without departing from the spirit and scope thereof.

What is claimed is:

1. A printing device for printing on a plate-making sheet for use in making a stamp:

the printing device comprising:

a plate-making sheet formed with a character check area to be printed with stamp characters for permitting checking of said stamp characters, and at least one indication character area to be printed with said stamp characters for indication of said stamp characters;

a printing mechanism for printing said stamp characters on said character check area and said at least one indication character area;

a feeding mechanism for feeding said plate-making sheet to said printing mechanism; and a sensor for detecting feed of said plate-making sheet to said printing mechanism;

wherein an image of said stamp characters printed on said character check area is identical in typeface with but different in boldness from an image of said stamp characters printed on said at least one indication character area.

2. A printing device according to claim 1, wherein said printing mechanism has a printing section for simultaneously carrying out printing on said character check area and printing on a mask for use in making said stamp.

3. A printing device according to claim 1, wherein said plate-making sheet comprises a backing sheet and an adhesive sheet laminated on said backing sheet and having a surface to be printed with said stamp characters; and wherein said character check area and said at least one indication character area are formed on said surface of said adhesive sheet.

* * * * *